US005257921A

United States Patent [19]

Clarke et al.

[11] Patent Number: 5,257,921

[45] Date of Patent: Nov. 2, 1993

[54] ELECTRONIC SLIDE VALVE POSITION INDICATOR

[75] Inventors: Jan D. Clarke, York; Steven A. Bennis, Lancaster; Buford B. Chidester; Gregory P. Klidonas, both of York; Stephen E. Klinger, Etters; Brian K. Mohlman, Seven Valleys, all of Pa.; Donald E. Sweigart, II, Hunt Valley, Md.

[73] Assignee: FES, Inc., York, Pa.

[21] Appl. No.: 885,576

[22] Filed: May 19, 1992

[51] Int. Cl.[5] ..... F01C 1/16; F01C 1/24

[52] U.S. Cl. ..... 418/201.2; 418/2; 324/207.17

[58] Field of Search ..... 418/201.2, 2; 340/870.32, 870.35, 870.36; 324/207.17, 207.18

[56] References Cited

U.S. PATENT DOCUMENTS

| | | | |
|---|---|---|---|
| 2,459,210 | 1/1949 | Ashcraft | 340/870.35 |
| 4,610,613 | 9/1986 | Szymaszek | 418/201.2 |
| 4,783,626 | 11/1988 | Shimizu | 340/870.36 |
| 4,857,919 | 8/1989 | Braswell | 324/207.18 |

*Primary Examiner*—Richard A. Bertsch
*Assistant Examiner*—Charles G. Freay
*Attorney, Agent, or Firm*—Herbert Messenger

[57] ABSTRACT

A closed stainless steel tube is used to provide pressure and media isolation between the core and coils of a sensor in the form of a variable core transformer. The core is connected to and moved with a slide valve of a screw compressor and its actuating piston. The current output from the secondary coil is converted into a voltage, linearized and communicated to a microprocessor for controlling the position of the slide valve and thereby the loading of the compressor.

5 Claims, 3 Drawing Sheets

ELECTRONIC SLIDE VALVE POSITION INDICATOR

BACKGROUND OF THE INVENTION

In screw compressors, unloading is typically achieved by means of a slide valve which is reciprocated along an axis which is parallel to the axes of the helical rotors. The position of the slide valve relative to the rotors adjusts the size and duration of opening of the suction port by changing the effective length of the rotors and thereby the trapped volume. Because the slide valve position is thus directly related to the compressor output, the position of the slide valve has been sensed and a feedback signal provided to the control system which controls compressor capacity by positioning the slide valve. Additionally, an indicator can be positioned by the slide valve as it is moved.

In the past, the feedback and/or indicator structure ordinarily required the passage of a rod through the compressor casing. The rod would move with the slide valve and, although the rod is sealed, there have been problems due to leakage. The sealing problems were overcome in U.S. Pat. No. 3,738,116 which has the rod located in a sealed tube. The rod is in an inner tube and carries a magnetic member which coacts with an annular magnetic member surrounding the inner tube. The position of the annular magnetic member gives a visual indication of the slide valve position. Additionally, the annular magnetic member coacts with reed switches located in the inner wall of the outer tube when the annular magnetic member and therefore the slide valve is at one or more specific locations. This, however, did not satisfy the need for a direct, continuous output indicative of the slide valve position which was provided by commonly assigned U.S. Pat. No. 4,743,170 which is hereby incorporated by reference. In that patent a stainless steel tube is used to provide pressure and media isolation. Permanent magnets are used to transfer mechanical energy across the barrier provided by the stainless steel tube and the resultant permanent magnet "coupling" mechanism permits the movement of a position indicating device such as a potentiometer with movement of the slide valve.

U.S. Pat. No. 4,610,612 discloses a rotary screw compressor using linearly variable differential transformers (LVDT) coupled to the slide valves. The rods connecting with the LVDT go through the compressor housing and require sealing. An LVDT has three coils which form the transformer. The primary coil is used to provide excitation to the magnet assembly and ultimately to the two secondary windings. The transfer of the excitation forms the basis for the position measurement.

In an LVDT, a sinusoidal source excites the magnet assembly and is of a high frequency, typically 10–20 kHz. The frequency is high enough to reduce the permeability of and the subsequent size of the magnetic core. The construction of the magnetic core must be precisely controlled in order to provide equal magnetic properties over the entire length of the magnet. An anomaly in the magnet will translate into a corresponding anomaly in the output of the LVDT.

The magnetic excitation of the core is transferred to the secondary windings. The construction of the secondary windings is also very critical. Each winding must contain a precise number of turns and be matched to the other secondary winding if the LVDT is to function properly. When the magnetic core is centered between the secondary coils, the output of the respective secondary coils will be equal and the differential output from the LVDT will be zero. Moving the magnetic core off mechanical center will result in a voltage increase in one of the coils and a subsequent decrease in the voltage output from the opposite coil. The voltage differential between the two coils forms the output from the LVDT.

The LVDT must be designed and sized to operate for a specific length of travel which is, typically, less than that of either of the secondary coils. The LVDT is, typically, twice as long as the length of travel it is intended to measure.

SUMMARY OF THE INVENTION

The present invention is directed to a device in which one end of a ferrous (steel) core is secured to a hydraulically actuated slide valve positioning piston and moves therewith. The other end of the core moves in a hermetically sealed stainless steel tube. The stainless steel tube is located within the windings of a variable core transformer which has a primary winding overlaid by a secondary winding. As the slide valve moves (i.e. loads and unloads the screw compressor) the core moves further into or out of the transformer coil thus increasing or decreasing the effective core and the consequent output current. The signal is then rectified, linearized, and conditioned to indicate 0% to 100% for the full stroke of the slide valve.

The present invention does not use permanent magnets for coupling, a differential transformer, a potentiometer or sense slide valve position through a differential or direct voltage measurement. The present invention uses a single coil to develop a current loop and does not rely on high frequency excitation and is, therefore, not as sensitive to electrical noise.

It is an object of this invention to transmit compressor slide valve movement to the compressor control panel without the need for a mechanical connection between the transmitter and the slide valve.

It is another object of this invention to provide a device with increased reliability and reduced susceptibility to mechanical vibration and contaminants.

It is a further object of this invention to eliminate the need for dynamic pressure seals in transferring motion from a pressurized to a non-pressurized environment.

It is an additional object of this invention to adapt existing compressors in the field for microprocessor control. These objects, and others as will become apparent hereinafter, are accomplished by the present invention.

Basically, a stainless steel tube is hermetically sealed to a screw compressor. The tube is surrounded by a primary winding which is, in turn, overlaid by a secondary winding. A ferrous core is connected to and movable with a slide valve and is movable within the tube wherein it acts as the core of variable core transformer.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
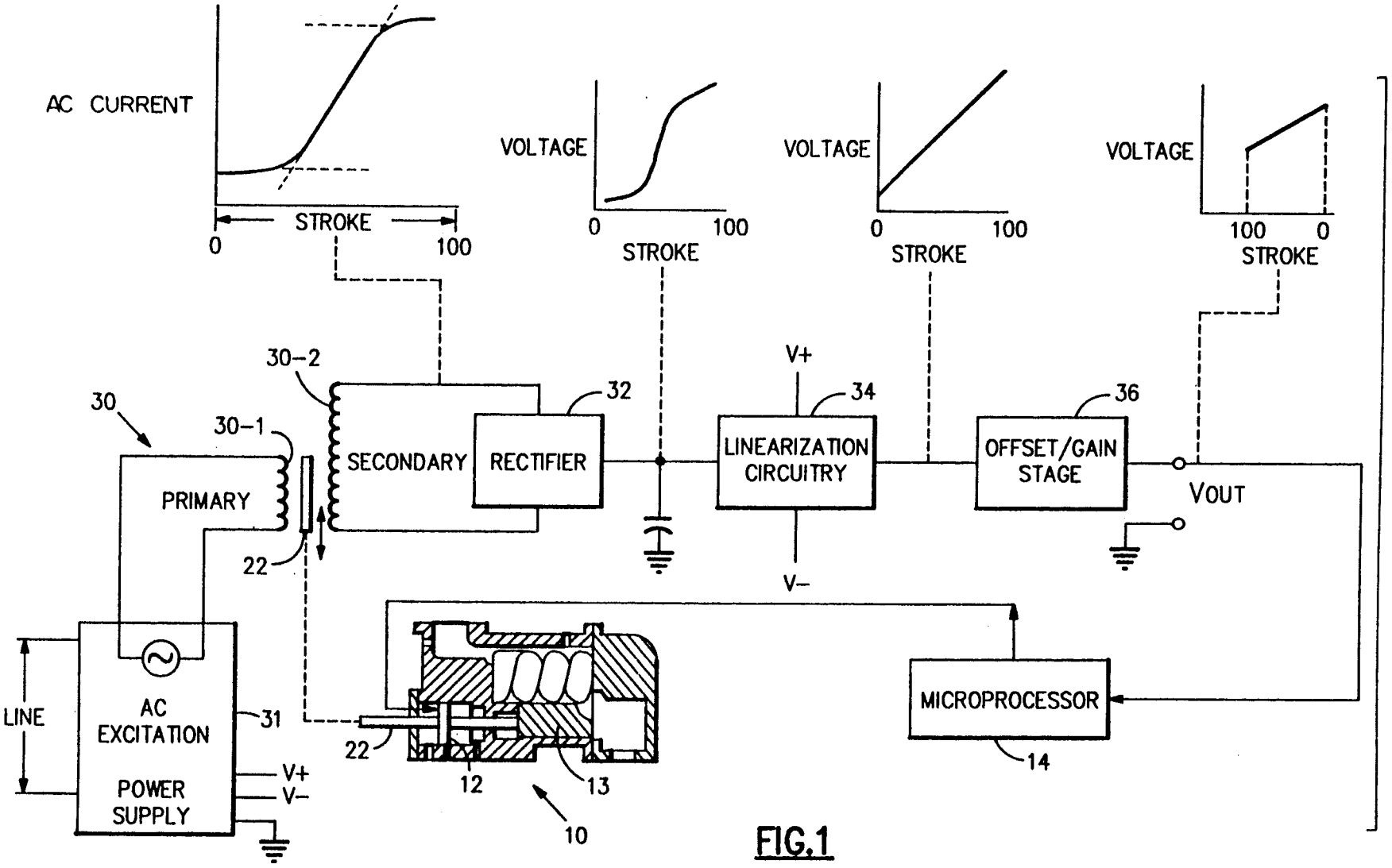
FIG. 1 is a schematic representation of an electrical circuit using the present invention for controlling a screw compressor.
Figure 2:
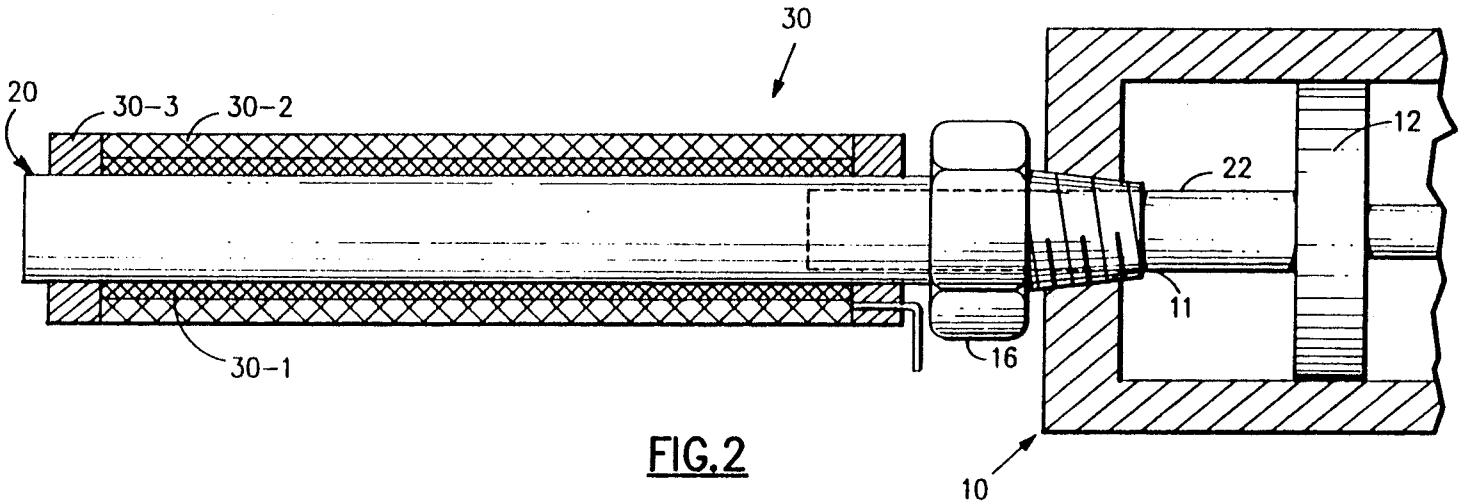
FIG. 2 is a partially sectional view of the variable core transformer and slide valve actuator.

In FIGS. 1 and 2 the numeral 10 generally designates a screw compressor in which capacity control is achieved by regulating the position of a slide valve 13 which is directly connected to piston 12. Piston 12, and thereby the slide valve 13, is moved by supplying pressurized fluid to the appropriate side of piston 12 via a four-way valve (not illustrated). The supplying of the pressurized fluid for moving piston 12 is under the control of microprocessor 14 which controls the capacity of screw compressor 10 responsive to system demands.

As is best shown in FIG. 2, threaded adapter 16 is threaded into threaded bore 11 of screw compressor 10 so as to provide a fluid-tight seal. The open end of stainless steel tube 20 is suitably secured to adapter 16, as by welding, so as to form a fluid-tight bond. The other end of tube 20 is closed so that tube 20 defines a closed chamber which is in fluid communication with the portion of the piston chamber located to the left of piston 12 as illustrated in FIG. 2. Ferrous rod or core 22 has one end threadedly or otherwise suitably connected to piston 12 so as to be moveable therewith while the other end is located within tube 20.

Figure 4:
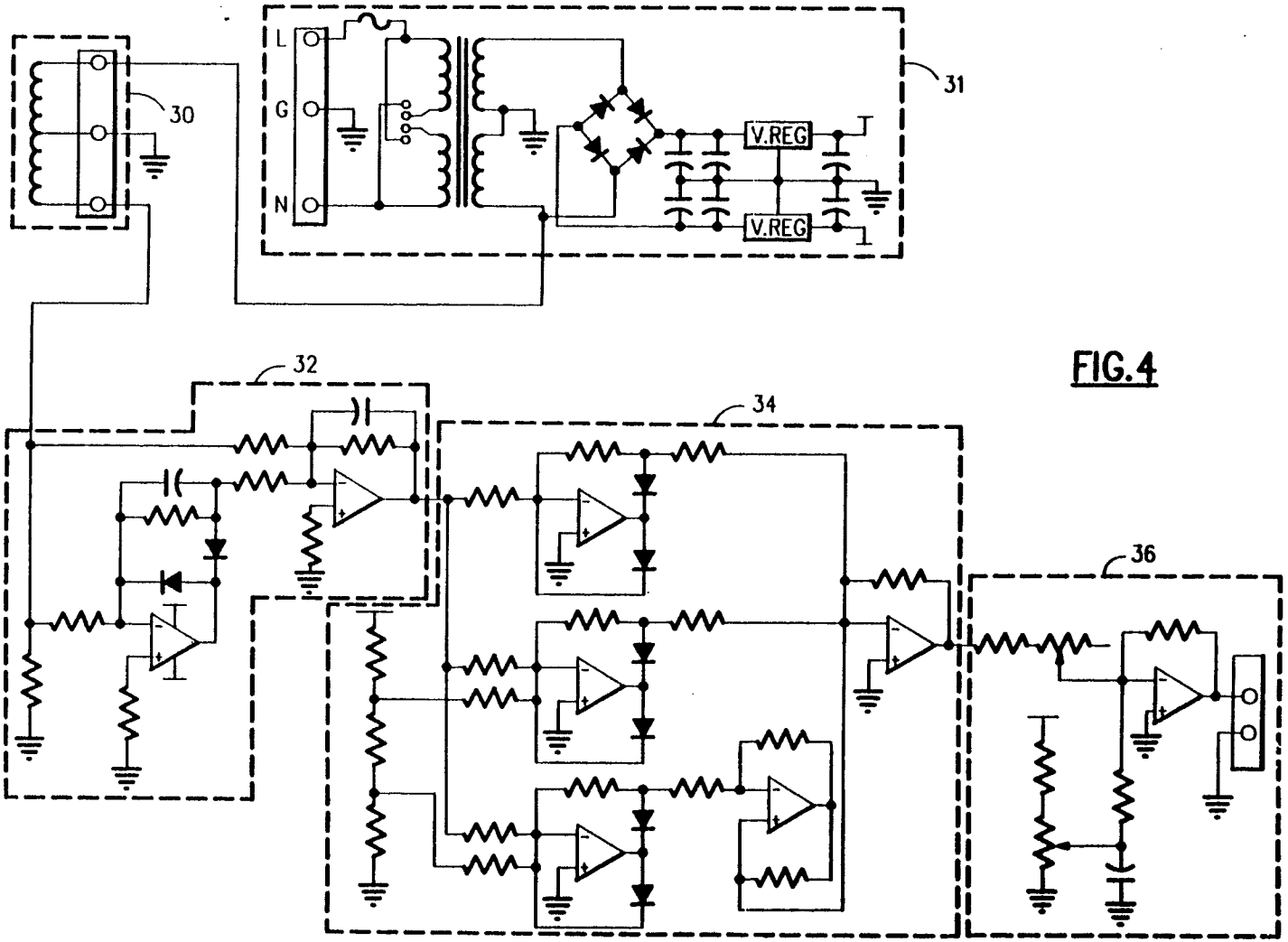
FIG. 4 is a detailed diagram of the electrical circuit.

Referring now to FIGS. 1 and 4, transformer 30 includes a primary coil 30-1 and a secondary coil 30-2. Typical AC line frequency (50/60 Hz) is supplied to primary coil 30-1 by power source 31 to provide the required excitation and is to be contrasted to the high frequency characteristic of an LVDT. The low frequency excitation is critical because ferrous core 22 must be sensed through the walls of stainless steel tube 20. A higher excitation frequency would saturate stainless steel tube 20 thereby significantly impairing the ability to sense the position of core 22. Thus the combination of a low excitation frequency and the stainless steel tube 20 combine to minimize the effects of the isolation provided by tube 20 on the output of the device while providing the required isolation.

The input excitation provided by power source 31 is transferred to the secondary coil 30-2 via the transformer core which is ferrous rod or core 22. As the rod 22 passes through the coil assembly, it affects the turns ratio of the transformer 30 because more turns are "added" to the secondary 30-2 as the coil is filled with the core. The change in the turns ratio corresponds to a change in the current that is transferred to, and flowing in, the secondary 30-2. The efficiency of the coil also increases as more core is inserted into the coil. The higher efficiency also contributes to increase current flow in the secondary coil 30-2. The current output from the coil assembly begins to level off as transformer efficiency stabilizes and the coil approaches saturation. The turns ratio and change in efficiency combine to produce a nonlinear current in the secondary coil of the coil assembly relative to the position of the core 22 within the coil assembly. The current characteristic with respect to the stroke of the slide valve/core 22 at the output of secondary coil 30-2 is shown graphically in FIG. 1.

The current output from the secondary coil 30-2 is converted into a voltage, rectified, and linearized through external electronics. The electronic circuitry consists of three sections: a rectifier circuit 32 which is an AC to true RMS converter, piece-wise linearization circuit 34 and offset/gain stage 36. The rectifier circuit 32 converts the AC current into a DC voltage that is ratiometric to the current as shown graphically. The piece-wise linearization circuit 34 divides the DC voltage into three sections (the dotted lines on the current graph) and adjusts the gain of the circuit (slope) for each section of the graph in order to provide a linearized output to the offset/gain stage 36.

The electronics are designed to allow a sufficient range of adjustment so the device may be used over a variety of stroke lengths. This flexibility allows one device to be used for a variety of stroke lengths where numerous LVDT devices would be required to provide the same flexibility.

Figure 3:
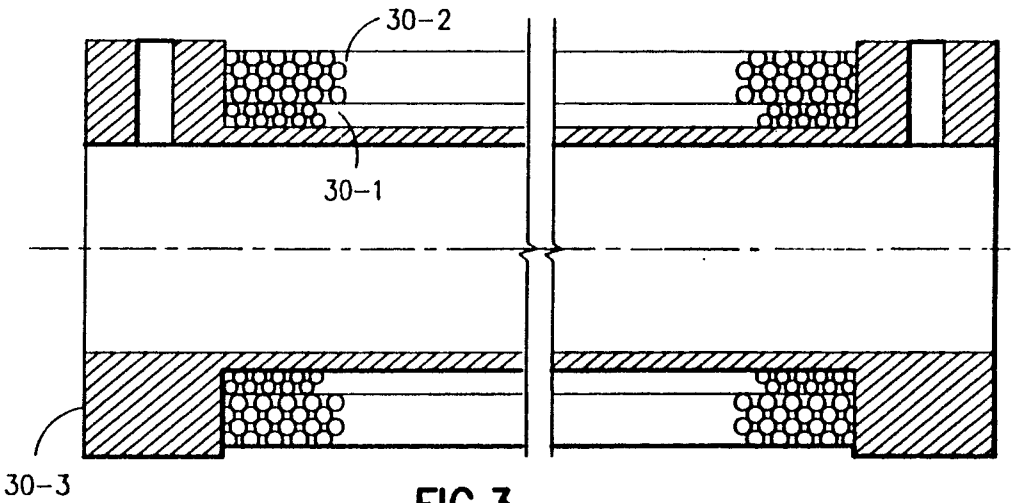
FIG. 3 is a sectional view of the winding structure of the variable core transformer.
Figure 3A:
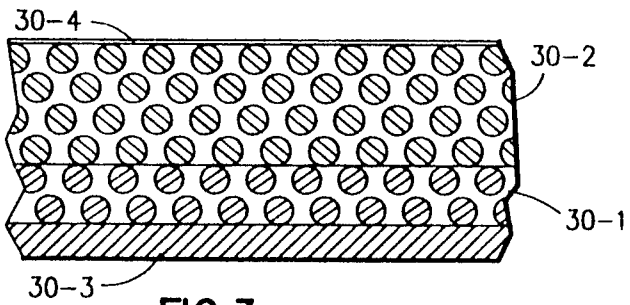
FIG. 3A is an enlarged view of a portion of FIG. 3.

Referring to FIGS. 2 and 3 it will be noted that the windings of primary coil 30-1 are wound on flanged coil retainer 30-3 and the windings of secondary coil 30-2 are wound on top of the windings of primary coil 30-1. Referring specifically to FIG. 3A the primary coil 30-1 has two layers of windings, secondary coil 30-2 has four layers of windings and is overlaid by tape/potting compound 30-4. The number of turns in the primary winding is fixed and then sized to limit the current flowing through the primary coil 30-1 to a minimum value—even when core 22 is not located in the coil assembly. With core 22 outside of the coil, the excitation would be dissipated as transformer loss.

Coil retainer 30-3 may be secured onto stainless steel tube 20 after threaded adapter 16 is threaded into bore 11 or may be secured to steel tube 20 which is then secured in place by threading adapter 16 into bore 11. With transformer 30 assembled as illustrated in FIG. 2, the output of the secondary coil will be a function of the position of core 22 which is, in turn, a function of the position of the slide valve 13. The current output from the coil 30-2 provides excellent noise immunity to line and other forms of electrical noise unlike a voltage device. The device may also be remotely mounted, allowing this device to be used in a Division II hazardous environment as defined by article 500 of the National Electrical Code, (NFPA date 1990) referring to impedance coils, transformers, etc. without protective devices required. The previous devices which contain potentiometers require intrinsically safe barriers or purge systems as defined in the national Electrical Code and NFPA 496.

In operation, under the control of microprocessor 14 and responsive to a sensed condition such as compressor suction pressure, hydraulic pressure is supplied via a four-way valve (not illustrated) to the appropriate side of piston 12 to move the slide valve 13 in the desired direction for controlling the loading of screw compressor 10. Movement of piston 12 and the slide valve 13 produces a corresponding movement of ferrous rod or core 22 which is secured to and moves as a unit with piston 12. Movement of core 22 may be into, out of, or within stainless steel tube 20. Since core 22 is the core of transformer 30, its position with respect to tube 20 and thereby coil retainer 30-3 dictates what, if any, current is supplied to secondary coil 30-2. The current output from coil 30-2 is converted into a voltage, rectified, linearized and communicated to microprocessor 14 and provides a feedback signal indicative of the actual position of the slide valve 13. The sensed compressor suction pressure and this feedback signal indicative of the position of the slide valve 13 thus provide sufficient information to microprocessor 14 for repositioning piston 12, and thereby the slide valve 13, as required.

Although a preferred embodiment of the present invention has been illustrated and described, other changes will occur to those skilled in the art. It is therefore intended that the scope of the present invention is to be limited only by the scope of the appended claims.

What is claimed is:

1. In a screw compressor having a slide valve and a chamber defining a pressurized environment and with a hydraulically actuated piston within a chamber for positioning said slide valve responsive to a microprocessor for controlling the capacity of the compressor, the improvement comprising:

a closed tube in fluid communication with said chamber;

a ferrous rod having a first end secured to said piston and a second end movable within said tube responsive to reciprocating movement of said piston and said slide valve;

a primary coil surrounding said tube;

means for supplying alternating current to said primary coil;

a secondary coil overlying said primary coil;

said ferrous rod and said primary and secondary coils defining a variable core transformer for producing an output of current from said secondary coil representative of the position of said rod within said transformer and which is also representative of the position of said slide valve within said compressor, said variable core transformer being operable to produce said output of current without using or measuring differential values of voltage or current associated with different portions of either of said coils.

2. The improvement of claim 1 wherein said closed tube is stainless steel.

3. The improvement of claim 1 wherein said rod is movable into, out of and within said closed tube.

4. The improvement of claim 1 further including circuit means for receiving said output of current from said transformer and providing a linearized output of voltage to said microprocessor representative of the position of said rod.

5. The improvement of claim 4 wherein said circuit means includes a rectifier for converting said output of current to a voltage and a linearization circuit for piecewise linearizing said voltage.

* * * * *